US007929708B2

(12) United States Patent
Reams et al.

(10) Patent No.: US 7,929,708 B2
(45) Date of Patent: Apr. 19, 2011

(54) AUDIO SPATIAL ENVIRONMENT ENGINE

(75) Inventors: Robert Reams, Lynwood, WA (US); Jeffrey K. Thompson, Bothell, WA (US); Aaron Warner, Seattle, WA (US)

(73) Assignee: DTS, Inc., Calabasas, CA (US)

( * ) Notice: Subject to any disclaimer, the term of this patent is extended or adjusted under 35 U.S.C. 154(b) by 1755 days.

(21) Appl. No.: 10/975,841

(22) Filed: Oct. 28, 2004

(65) Prior Publication Data

US 2005/0169482 A1 Aug. 4, 2005

(51) Int. Cl.
*H04R 5/00* (2006.01)
*H04R 5/02* (2006.01)

(52) U.S. Cl. ..... 381/17; 381/310

(58) Field of Classification Search ..... 381/61, 381/17–23, 310, 80, 97, 102, 104, 107, 74, 381/309, 1

See application file for complete search history.

(56) References Cited

U.S. PATENT DOCUMENTS

| | | | | |
|---|---|---|---|---|
| 3,732,370 | A | 5/1973 | Sacks | |
| 4,458,362 | A | 7/1984 | Berkovitz et al. | |
| 4,748,669 | A | 5/1988 | Klayman | |
| 4,866,774 | A | 9/1989 | Klayman | |
| 5,434,948 | A | 7/1995 | Holt et al. | |
| 5,481,615 | A | 1/1996 | Eatwell et al. | |
| 5,796,844 | A * | 8/1998 | Griesinger | 381/18 |
| 5,899,970 | A | 5/1999 | Sonohara | |
| 6,173,061 | B1 | 1/2001 | Norris et al. | |
| 2002/0071574 | A1 | 6/2002 | Aylward et al. | |
| 2002/0120458 | A1 | 8/2002 | Silfvast et al. | |
| 2004/0105550 | A1 * | 6/2004 | Aylward et al. | 381/17 |

FOREIGN PATENT DOCUMENTS

EP 0571635 A 10/1993

OTHER PUBLICATIONS

Written Opinion from PCT/US01/28088 dated Jun. 18, 2003 (8 pgs).
Search Report from PCT/US01/28088 dated Dec. 17, 2002 (6 pgs).
PCT International Search Report and Written Opinion from PCT/US2007/004711, dated Jun. 29, 2007 (9 pgs.).
Chang et al., "A Masking-Threshold-Adapted Weighting Filter for Excitation Search," IEEE Transactions on Speech and Audio Processing, IEEE Service Center, New York, vol. 4, No. 2, Mar. 2, 1996 (9 pgs.).

(Continued)

*Primary Examiner* — Vivian Chin
*Assistant Examiner* — Kile Blair
(74) *Attorney, Agent, or Firm* — William L. Johnson; Gaurav K. Mohindra; Blake A. Welcher

(57) ABSTRACT

An audio spatial environment engine for converting from an N channel audio system to an M channel audio system, where N is an integer greater than M, is provided. The audio spatial environment engine includes one or more correlators receiving two of the N channels of audio data and eliminating delays between the channels that are irrelevant to an average human listener. One or more Hilbert transform systems each perform a Hilbert transform on one or more of the correlated channels of audio data. One or more summers receive at least one of the correlated channels of audio data and at least one of the Hilbert transformed correlated channels of audio data and generate one of the M channels of audio data.

18 Claims, 9 Drawing Sheets

100

OTHER PUBLICATIONS

J. Herre et al., "The Reference Model Architecture for MPEG Spatial Audio Coding," Audio Engineering Society Convention Paper 6447, Presented at the 118th Convention, May 28-31, 2005, Barcelona, Spain (13 pgs.).

Brandenburg, "Low Bitrate Audio Coding—State-of-the-Art, Challenges and Future Directions," Communication Technology Proceedings, 2000. WCC—ICCT 2000. International Conference on Beijing, China, Aug. 21-25, 2000, Piscataway, NJ, vol. 1, Aug. 21, 2000 (4 pgs.).

Xu et al., "Stream-Based Interactive Video Language Authoring Using Correlated Audiovisual Watermarking," Proceedings of the Third International Conference on Information Technology and Applications (ICITA'05), © 2005 IEEE (4 pgs.).

Mouri et al., "Surround Sound Reproducing System with Two Front Speakers," Consumer Electronics, 1997, Digest of Technical Papers, Jun. 11, 1997, pp. 300-301.

Avendano et al., "Ambience Extraction and Synthesis from Stereo Signals for Multi-Channel Audio Up-Mix," 2002 IEEE International Conference on Acoustics, Speech, and Signal Processing Proceedings, May 13, 2002, pp. II-1957-II-1960.

PCT International Search Report mailed Sep. 4, 2006.

* cited by examiner 202
0 50 100
204
0 50 100
206
0 50 100
MAGNITUDE RATIO VALUE SYSTEM 230
L. FRONT CHANNEL OUT
R. FRONT CHANNEL OUT
MULTIPLIER 228
ADDER 222
MULTIPLIER 214
MULTIPLIER 216
S. LEFT IN
S. RIGHT IN
CENTER OUT
MULTIPLIER 220
MULTIPLIER 226
S. LEFT PLUS S. RIGHT CHANNEL IN
200

LEFT REAR CHANNEL OUT
RIGHT REAR CHANNEL OUT
MULTIPLIER 218
MULTIPLIER 224
S. LEFT MINUS S. RIGHT CHANNEL IN
208
0 90 180
210
0 90 180
212
0 90 180
PHASE DIFFERENCE SYSTEM 232

AUDIO SPATIAL ENVIRONMENT ENGINE

FIELD OF THE INVENTION

The present invention pertains to the field of audio data processing, and more particularly to a system and method for transforming between two-channel stereo data and N- channel data.

BACKGROUND OF THE INVENTION

Systems and methods for processing audio data are known in the art. Most of these systems and methods are used to process audio data for a known audio environment, such as a two-channel stereo environment, a four-channel quadraphonic environment, a five channel surround sound environment (also known as a 5.1 channel environment), or other suitable formats or environments.

One problem posed by the increasing number of formats or environments is that audio data that is processed for optimal audio quality in a first environment is often not able to be readily used in a different audio environment. One example of this problem is the conversion of stereo sound data to surround sound data. A listener can perceive a noticeable change in sound quality when programming changes from surround sound encoding to stereo encoding. However, as the additional channels of audio data for surround sound encoding are not present in the stereo two-channel data, existing surround systems are unable to change the way such sound is processed.

SUMMARY OF THE INVENTION

In accordance with the present invention, a system and method for an audio spatial environment engine are provided that overcome known problems with converting between spatial audio environments.

In particular, a system and method for an audio spatial environment engine are provided that allows conversion between N-channel data and M-channel data, where N and M are integers.

In accordance with an exemplary embodiment of the present invention, an audio spatial environment engine for converting from an N channel audio system to an M channel audio system, where N is an integer greater than M, is provided. The audio spatial environment engine includes one or more correlators receiving two or more of the N channels of audio data and eliminating delays between the channels that are irrelevant to an average human listener. One or more Hilbert transform systems each perform a Hilbert transform on one or more of the correlated channels of audio data. One or more summers receive at least one of the correlated channels of audio data and at least one of the Hilbert transformed correlated channels of audio data and generate one of the M channels of audio data.

The present invention provides many important technical advantages. One important technical advantage of the present invention is a system and method for an audio spatial environment engine that uses magnitude and phase functions for each speaker in an audio system to allow sound that is optimized for an N-speaker system to be converted into sound that is optimized for an M-speaker system.

Those skilled in the art will further appreciate the advantages and superior features of the invention together with other important aspects thereof on reading the detailed description that follows in conjunction with the drawings.

DETAILED DESCRIPTION OF PREFERRED EMBODIMENTS

Figure 1:
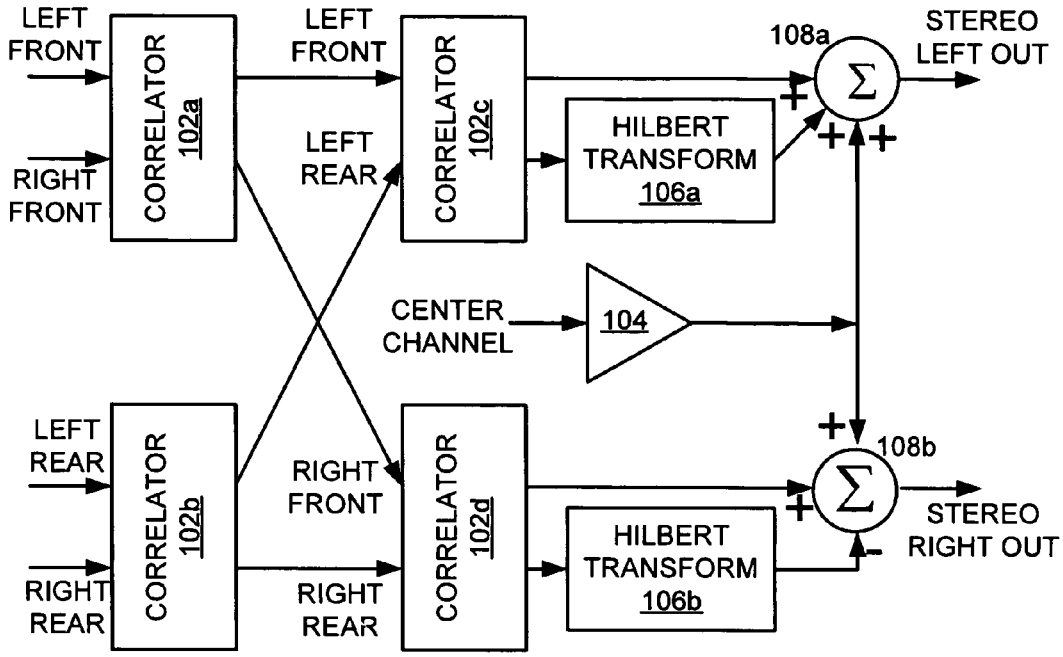
FIG. 1 is a diagram of a system for generating stereo left and right channel output from N-channel input in accordance with an exemplary embodiment of the present invention.

In the description that follows, like parts are marked throughout the specification and drawings with the same reference numerals, respectively. The drawing figures might not be to scale, and certain components can be shown in generalized or schematic form and identified by commercial designations in the interest of clarity and conciseness.

FIG. 1 is a diagram of a system 100 for generating stereo left and right channel output from N-channel input in accordance with an exemplary embodiment of the present invention. System 100 can be implemented in hardware, software, or a suitable combination of hardware and software, and can be one or more software systems operating on a suitable hardware platform. As used herein, a hardware system can include discrete or integrated semiconductor devices implemented in silicon, germanium, or other suitable materials; an application-specific integrated circuit; a field programmable gate array; a general purpose processing platform, a digital signal processor, or other suitable devices. A software system can include one or more objects, agents, threads, lines of code, subroutines, separate software applications, user-readable (source) code, machine-readable (object) code, two or more lines of code in two or more corresponding software applications, databases, or other suitable software architectures. In one exemplary embodiment, a software system can include one or more lines of code in a general purpose software application, such as an operating system of a digital signal processor, and one or more lines of software in a specific purpose software application. The term "couple" and its cognate terms, such as "coupled" and couples," can include a physical connection (such as through a conducting material in a semiconductor circuit), a logical connection (such as through one or more logical devices of a semiconducting circuit), a virtual connection (such as through one or more randomly assigned memory locations of a data memory device), other suitable connections, or a suitable combination of such connections. In one exemplary embodiment, systems or components can be coupled to other systems and components through intervening systems and components, such as through an operating system of a memory controller.

In the exemplary embodiment of system 100, five channel or so-called 5.1 sound is being converted into stereo left and right channel output, but other suitable numbers of input channels can also or alternatively be converted into stereo output.

System 100 includes correlator 102*a*, which receives left front channel and right front channel input and correlates the data to eliminate time delays below a predetermined maximum time delay, such as seven milliseconds. In this exemplary embodiment, correlator 102*a* can receive analog data, digital data, or other suitable data and can correlate the signals to eliminate delays between the channels of data that are irrelevant to an average human listener. Correlator 102*a* outputs front correlated left front channel data and front correlated right front channel data.

In the same manner, correlator 102*b* receives left rear channel data and right rear channel data and correlates the data to eliminate time delays below a predetermined maximum time delay, such as seven milliseconds. In this exemplary embodiment, correlator 102*b* can receive analog data, digital data, frequency domain data, or other suitable data and can correlate the signals to eliminate delays between the channels of data that are irrelevant to human listeners. Correlator 102*b* outputs rear correlated left rear channel data and rear correlated right rear channel data.

Correlator 102*c* receives front correlated left front channel data and rear correlated left rear channel data and correlates the data to eliminate time offsets below a predetermined maximum time delay, such as seven milliseconds. In this exemplary embodiment, correlator 102*c* can receive analog data, digital data, frequency domain data, or other suitable data and can correlate the signals to eliminate time offsets between the channels of data that are below levels perceptible by human listeners. Correlator 102*c* outputs front-rear correlated left front channel data and rear-front correlated left rear channel data.

Correlator 102*d* receives front correlated right front channel data and rear correlated right rear channel data and correlates the data to eliminate time offsets below a predetermined maximum time delay, such as seven milliseconds. In this exemplary embodiment, correlator 102*c* can receive analog data, digital data, or other suitable data and can correlate the signals to eliminate delays between the channels of data that are irrelevant to human listeners. Correlator 102*d* outputs front-rear correlated right front channel data and rear-front correlated right rear channel data.

Center channel data is provided to multiplier 104, the output of which is the multiplied value of the center channel data. In one exemplary embodiment, multiplier 104 can multiply the center channel data by 0.707, altering the "gain" of the center channel data, such as where the output of the system is a stereo channel output.

Hilbert transform 106*a* receives the rear-front correlated left rear channel data and performs a Hilbert transform on the data, such as:

$$g(y) = \frac{1}{\pi}\int_{-\infty}^{\infty}\frac{f(x)\,dx}{x-y}$$

$$f(x) = \frac{1}{\pi}\int_{-\infty}^{\infty}\frac{g(y)\,dy}{y-x}.$$

Those skilled in the art will recognize that negative frequencies of the correlated channels of audio data are phase shifted +90° and positive frequencies of the correlated channels of audio data are phase shifted −90° as a result of the well known inherent properties of the Hilbert transform.

The output of Hilbert transform 106*a* is summed at summer 108*a* with the front-rear correlated left front channel data and the multiplied center channel data to generate the stereo left output signal. Hilbert transform 106*b* receives the rear-front correlated right rear channel data and performs a Hilbert transform on the data.

The output of Hilbert transform 106*b* is subtracted at summer 108*b* from the sum of the front-rear correlated right front channel data and the multiplied center channel data to generate the stereo right output signal.

In operation, system 100 allows an N-channel input to be converted into a 2-dimensional stereo output, such as by eliminating time delays between the front and rear channel signals that are below the level of human perception, by performing a suitable transform on one or more channels of the correlated data, such as a Hilbert transform, by multiplying one or more channels of the data by a suitable scaling factor, and then combining the processed N-channel data to generate stereo left and right channel data. In this manner, a system that is configured to generate stereo channel data, such as a system having two speakers, can receive N-channel data and output sound having a spatial quality that is compatible with sound that has processed for two channel, left-right stereo speaker delivery.

Figure 2:
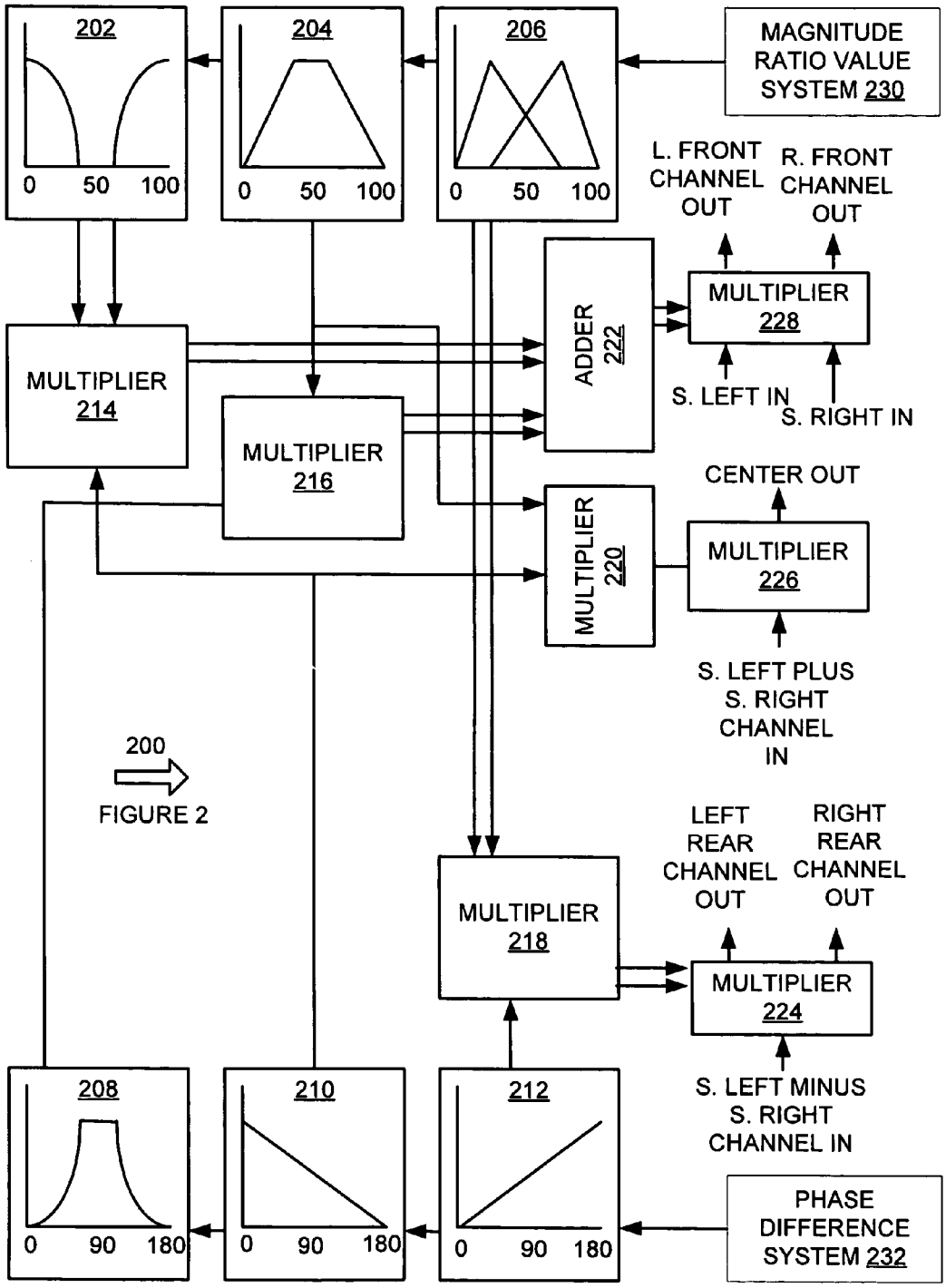
FIG. 2 is a diagram of a system for generating N-channel output from stereo left and right channel input in accordance with an exemplary embodiment of the present invention.

FIG. 2 is a diagram of a system 200 for generating N-channel output from stereo left and right channel input in accordance with an exemplary embodiment of the present invention. In the exemplary embodiment of system 100, stereo left and right channel input is being converted into five channel or so-called 5.1 sound, but other suitable numbers of input channels can also or alternatively be converted into N-channel output.

System 200 includes left and right magnitude function 202, which generates a value ranging between 0.0 and 1.0 or between other suitable values based on an input value from magnitude ratio value system 230, which determines the percentage energy in the left and right channels, which is also referred to as the magnitude ratio value or M.R.V. The magnitude ratio value can be determined by dividing the left magnitude by the sum of the left and right magnitude for each sub-band or frequency bin of a time to frequency transformed sample, such as a fast Fourier transformed sample or other suitable samples. In one exemplary embodiment, the time to frequency sample can be a 2048 point time to frequency conversion over a fixed sample, such as a 23.5 millisecond sample, resulting in several frequency and magnitude values, such as 1024. Other suitable sample sizes of time to frequency transforms can be used. The M.R.V. for each transform bin can be independently processed, can be processed in predetermined groups, or other suitable processing can be used. Left and right magnitude function 202 can be empirically or analytically determined, and outputs a maximum left channel value starting at an M.R.V. of 0.0 and decreasing as M.R.V. approaches 50%. Likewise, the right channel value is zero as M.R.V. goes from 0.0 until after it reaches 50%, at which point it increases to a maximum when M.R.V. equals 100%.

Center magnitude function 204 receives the output from the magnitude ratio value system 230 and generates a maximum value when the magnitude of the left and right channels is equal, which occurs when M.R.V. is around 50%. The center magnitude function 204 falls off as the M.R.V. moves away from 50% towards 0.0% and 100%, and the slope of the fall-off can be determined analytically or empirically, can be symmetric or asymmetric, can be linear or non-linear, and can have other suitable characteristics.

Left and right surround magnitude function 206 receives the output from the magnitude ratio value system 230 and generates an output based on functions determined on encoder parameters, either empirically or analytically. In one exemplary embodiment, as M.R.V. increases from 0.0%, the left surround magnitude function begins to increase until it reaches a maximum value at a point less than an M.R.V. value of 50%. Likewise, the right surround magnitude function begins to increase from 0.0 at some point between 0.0% and 0.50% M.R.V. The left surround function then begins to drop off as M.R.V. continues to increase, and eventually reaches zero before M.R.V. reaches 100%. The right surround function increases until it reaches a maximum between 50.0% M.R.V. and 100.0% M.R.V. and then falls off to zero by the time M.R.V. reaches 100.0%. The slope of the rise and fall-off of the left surround function and the right surround function can be determined analytically or empirically, can be symmetric or asymmetric, can be linear or non-linear, and can have other suitable characteristics.

In addition to the magnitude functions, phase functions are also used to generate phase information. Phase difference system 232 generates phase difference data and provide the phase difference data to front phase function 208, left-right phase function 210, and rear phase function 212. The input to the phase information for each frequency bin or sub-band can be the phase difference between the stereo left and right channel, a running-average coherence based on whether the left and right channel are in phase or up to 180 degrees out of phase, or other suitable data. Front phase function 208 receives the phase difference between the left and the right channel and increases from a minimum to a maximum value as the difference increases from 0.0 degrees to a maximum as the value approaches 90 degrees. The front phase function 208 then remains at a maximum and starts to fall off as the phase difference increases towards 180 degrees. The slope of the rise, the point at which maximum is reached, the section over which the maximum is maintained, and the slope of the fall-off of the front phase function can be determined analytically or empirically, can be symmetric or asymmetric, can be linear or non-linear, and can have other suitable characteristics.

Left-right phase function 210 starts at a maximum value as the phase difference between the left and right channels is zero, and decreases as the phase difference drops off until it reaches 0.0 when the phase difference is 180 degrees. The slope of the fall-off of the left-right phase function can be determined analytically or empirically, can be linear or non-linear, and can have other suitable characteristics.

Rear phase function 212 starts at a minimum value as the phase difference between the left and right channels is zero, and increases as the phase difference drops off until it reaches the maximum when the phase difference is 180 degrees. The slope of the increase of the rear phase function can be determined analytically or empirically, can be linear or non-linear, and can have other suitable characteristics.

Multiplier 214 receives the output from left and right magnitude function 202, which includes a left channel value and a right channel value, and multiplies these values by the corresponding value from left-right phase function 210 for the corresponding frequency bin or sub-band. The output from multiplier 214 is then provided to adder 222. Likewise, the output from center magnitude function 204 is multiplied with the output from front phase function 208 by multiplier 216, and redundant channel outputs are provided to added 222 for combination with the output from multiplier 214. The output from adder 222 is then provided to multiplier 228, which multiplies the left channel value times the stereo left channel input to generate the left front channel output for a 5.1 sound system. Likewise, multiplier 228 multiplies the right channel value times the stereo right channel input to generate the right front channel output for a 5.1 sound system, such as after performing a frequency to time transformation, such as a reverse FFT.

Multiplier 218 receives the output from left and right surround magnitude function 206 and multiplies it by the output from rear phase function 212 for the corresponding frequency bin or sub-band. The outputs from multiplier 212 are then provided to multiplier 224, which receive the stereo left channel input minus the stereo right channel input, and multiplies this value times the outputs from multiplier 212 to generate the left rear channel output and the right rear channel output for 5.1 sound system, such as after performing a frequency to time transformation.

The center output for a 5.1 sound system is generated by multiplying the output from center magnitude function 204 with the output from left-right phase function 210 for the corresponding frequency bin or sub-band. The resultant value is then multiplied times the sum of the stereo left channel plus the stereo right channel. A frequency to time transform or other suitable processing is then performed to generate the center output for the 5.1 sound system.

In operation, system 200 allows stereo input to be converted into N-channel input, such as 5.1 sound system input which includes a front left and right speaker, a rear left and right speaker, and a center speaker (as well as typically a sub-woofer that is optional and not a factor in forming the sound image). System 200 thus allows a stereo signal that is optimized for a listener at the apex of an equilateral triangle between a left speaker and a right speaker to be converted for a system where there are N-speakers, such as a 5.1 sound system or other suitable systems.

Figure 3:
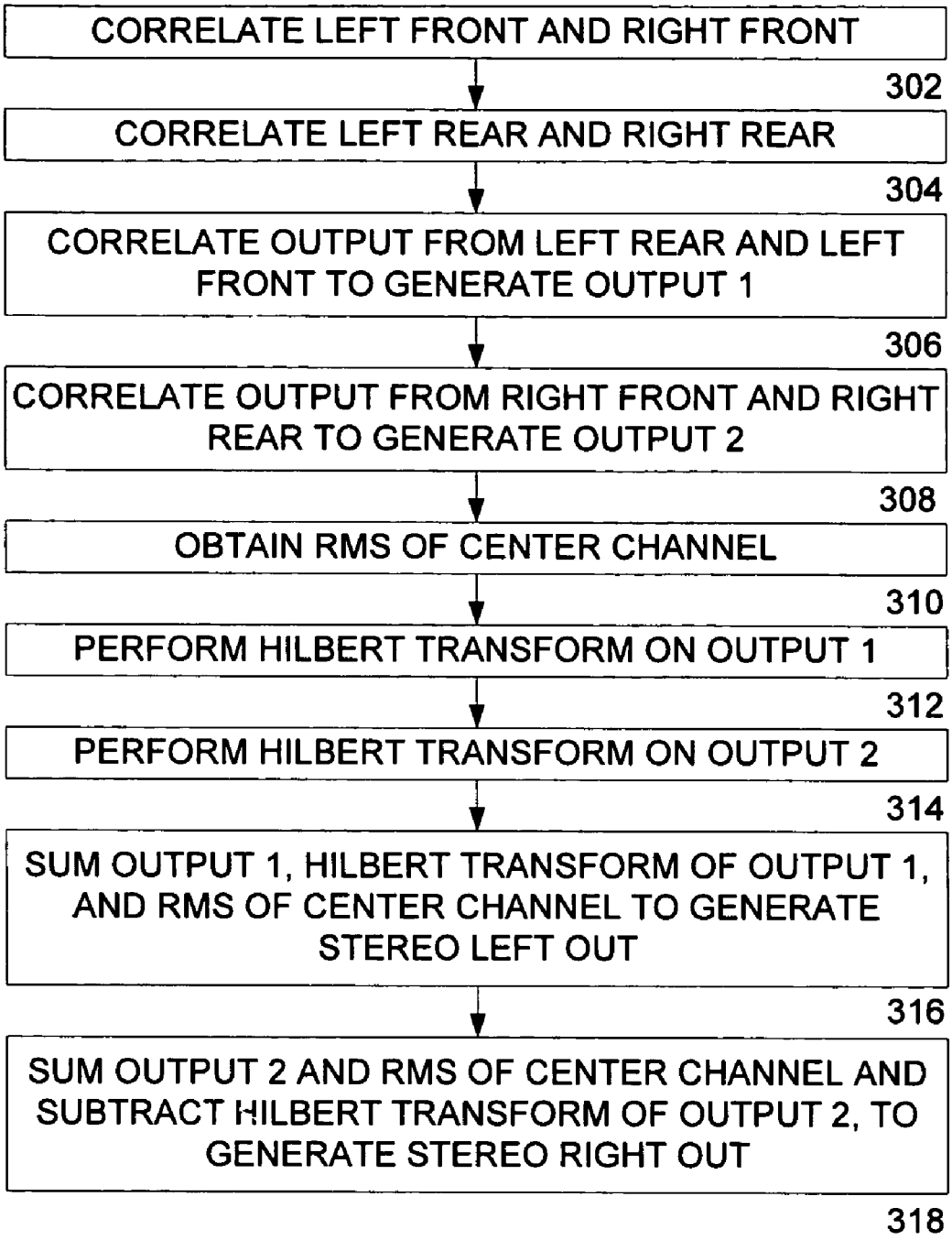
FIG. 3 is a flow chart of a method for converting N-channel sound, such as 5.1 sound, into stereo sound in accordance with an exemplary embodiment of the present invention.

FIG. 3 is a flow chart of a method 300 for converting N-channel sound, such as 5.1 sound, into stereo sound in accordance with an exemplary embodiment of the present invention. Method 300 begins at 302, where the left front and right front signals are correlated, such as to eliminate time offsets between channels of data that are irrelevant to human listeners. In one exemplary embodiment, such as for 5.1 sound, there can be a single left front signal and a single right front signal, but other suitable numbers of channels can be used. After correlation, front correlated left front channel data and front correlated right front channel data are generated. The method then proceeds to 304.

At 304, the left rear and right rear signals are correlated, such as to eliminate time offsets between channels of data that are irrelevant to human listeners. In one exemplary embodiment, such as for 5.1 sound, there can be a single left rear signal and a single right rear signal, but other suitable numbers of channels can be used. After correlation, rear correlated left rear channel data and rear correlated right rear channel data are generated. The method then proceeds to 304.

At 306, the front correlated left front channel data and the rear correlated left rear channel data are received and correlated to eliminate time offsets that are irrelevant to human listeners, such as seven milliseconds. In this exemplary embodiment, using 5.1 sound, front-rear correlated left front channel data and rear-front correlated left rear channel data are output, but other suitable combinations of channel data can also or alternatively be generated. The method then proceeds to 308.

At 308, the front correlated right front channel data and the rear correlated right rear channel data are received and correlated to eliminate time offsets that are irrelevant to human listeners, such as seven milliseconds. In this exemplary embodiment, using 5.1 sound, front-rear correlated right front channel data and rear-front correlated right rear channel data are output, but other suitable combinations of channel data can also or alternatively be generated. The method then proceeds to 310.

At 310, the center channel is multiplied by suitable factor, such as to generate the root mean square of the center channel data for broadcast through two stereo channels, or other multiplication factors can be used. The method then proceeds to 312 where a Hilbert transform is performed on the rear-front correlated left rear channel data. Likewise, other suitable transforms can be performed on other suitable channels of data. The method then proceeds to 314.

At 314, a Hilbert transform is performed on the rear-front correlated right rear channel data. Likewise, other suitable transforms can be performed on other suitable channels of data. The method then proceeds to 316. At 316, the front-rear correlated left front channel data and Hilbert-transformed rear-front correlated left rear channel data are summed with the amplitude-adjusted center channel data to generate stereo left channel output. The method then proceeds to 318, where the Hilbert-transformed rear-front correlated right rear channel data is subtracted from the front-rear correlated right front channel data and the amplitude-adjusted center channel data to generate stereo right channel output.

In operation, method 300 can be used to transform N-channel sound, such as 5.1 sound, into 2-channel stereo sound, by using the known, predetermined spatial relationships of the N-channel sound to process the sound for transmission over left and right channel stereo speakers. Likewise, other suitable processes can be used, such as to convert from N-channel sound to M-channel sound, where N is an integer greater than 2 and M is an integer greater than or equal to 1.

Figure 4A:
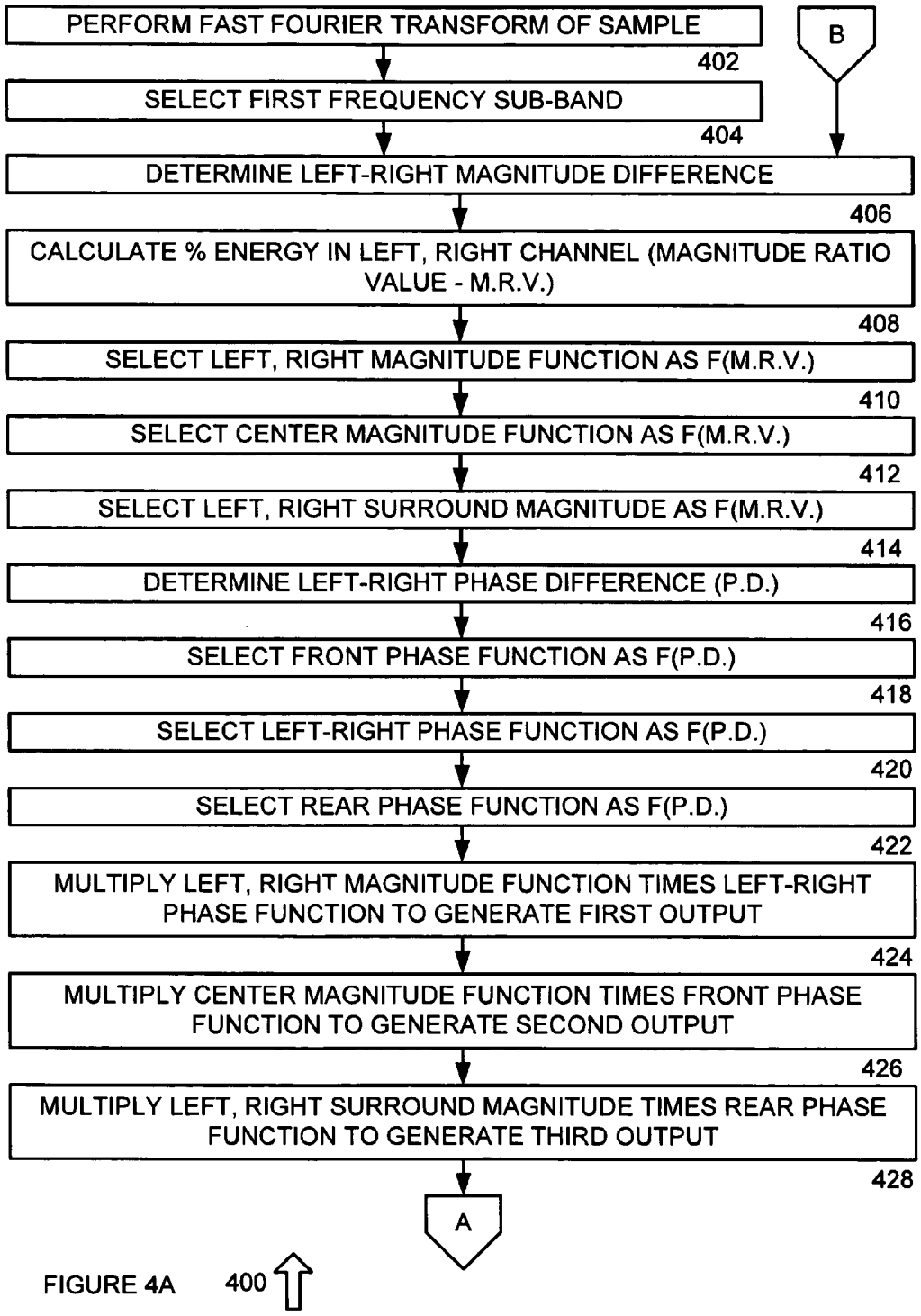
FIGS. 4A and 4B are a flow chart of a method for converting two channel stereo sound into N-channel sound, such as 5.1 sound, in accordance with an exemplary embodiment of the present invention.
Figure 4B:
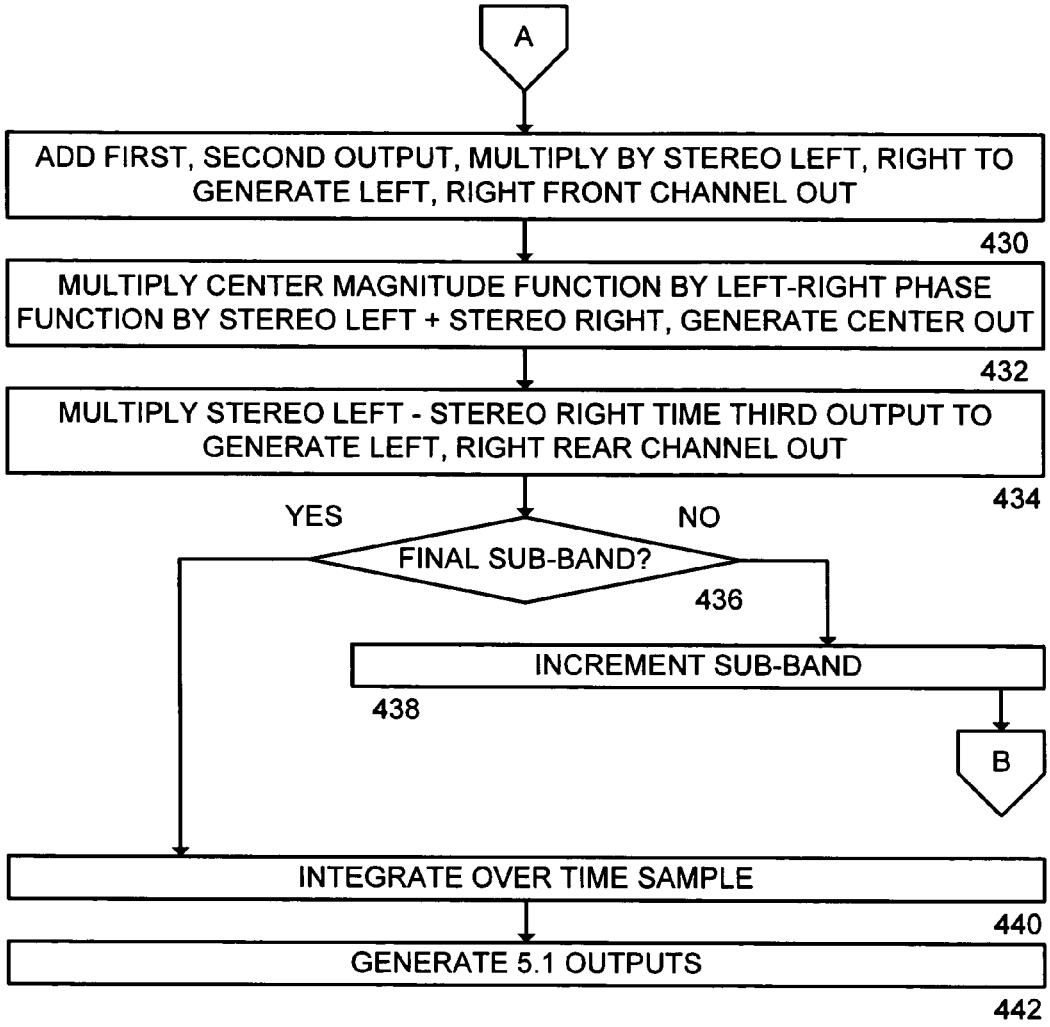
Figure 5A:
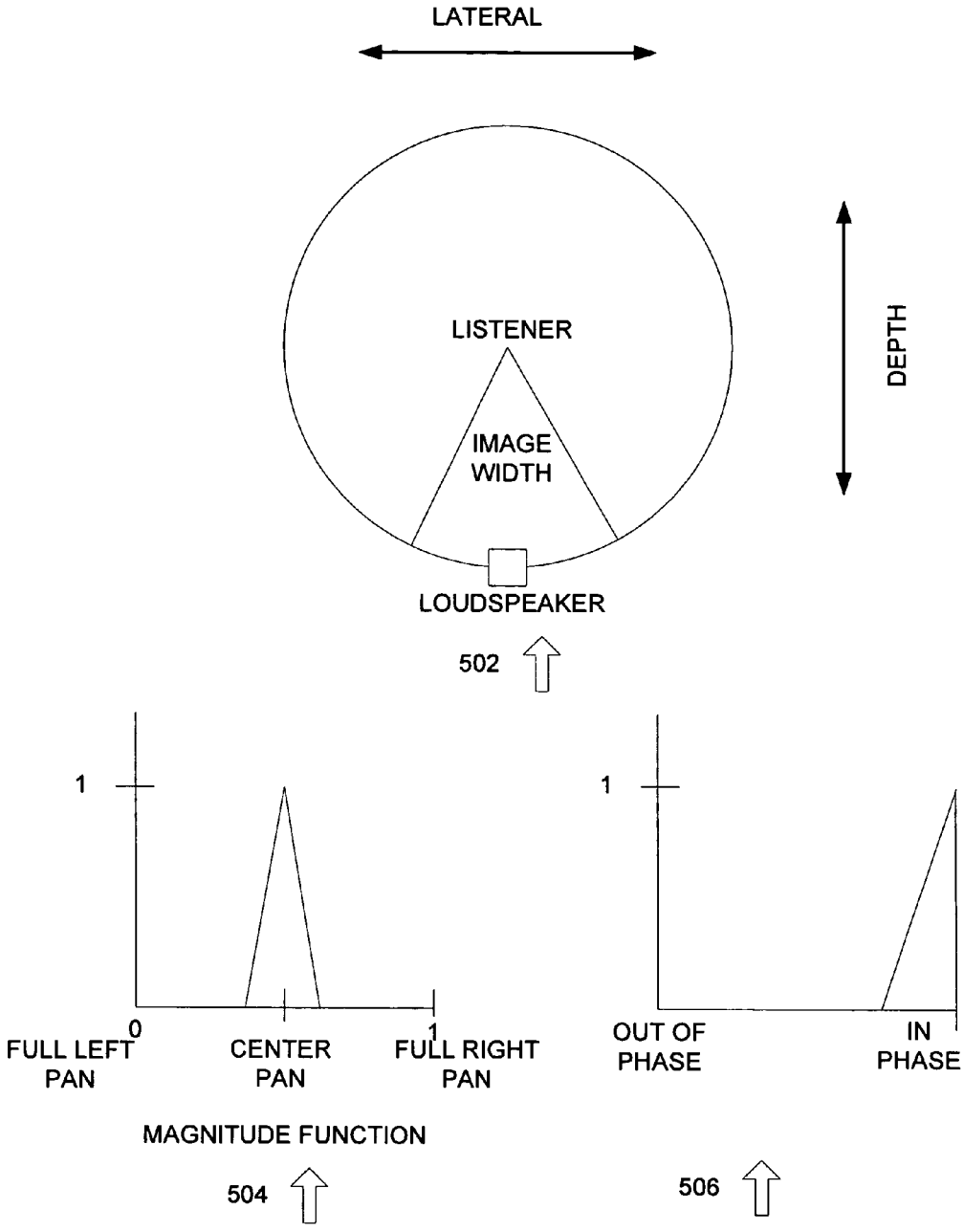
FIGS. 5A through 5D are diagrams of an exemplary process for determining magnitude and phase functions as a function of loudspeaker location and image width, based on the depth and lateral location of the listener relative to the loudspeaker.
Figure 5B:
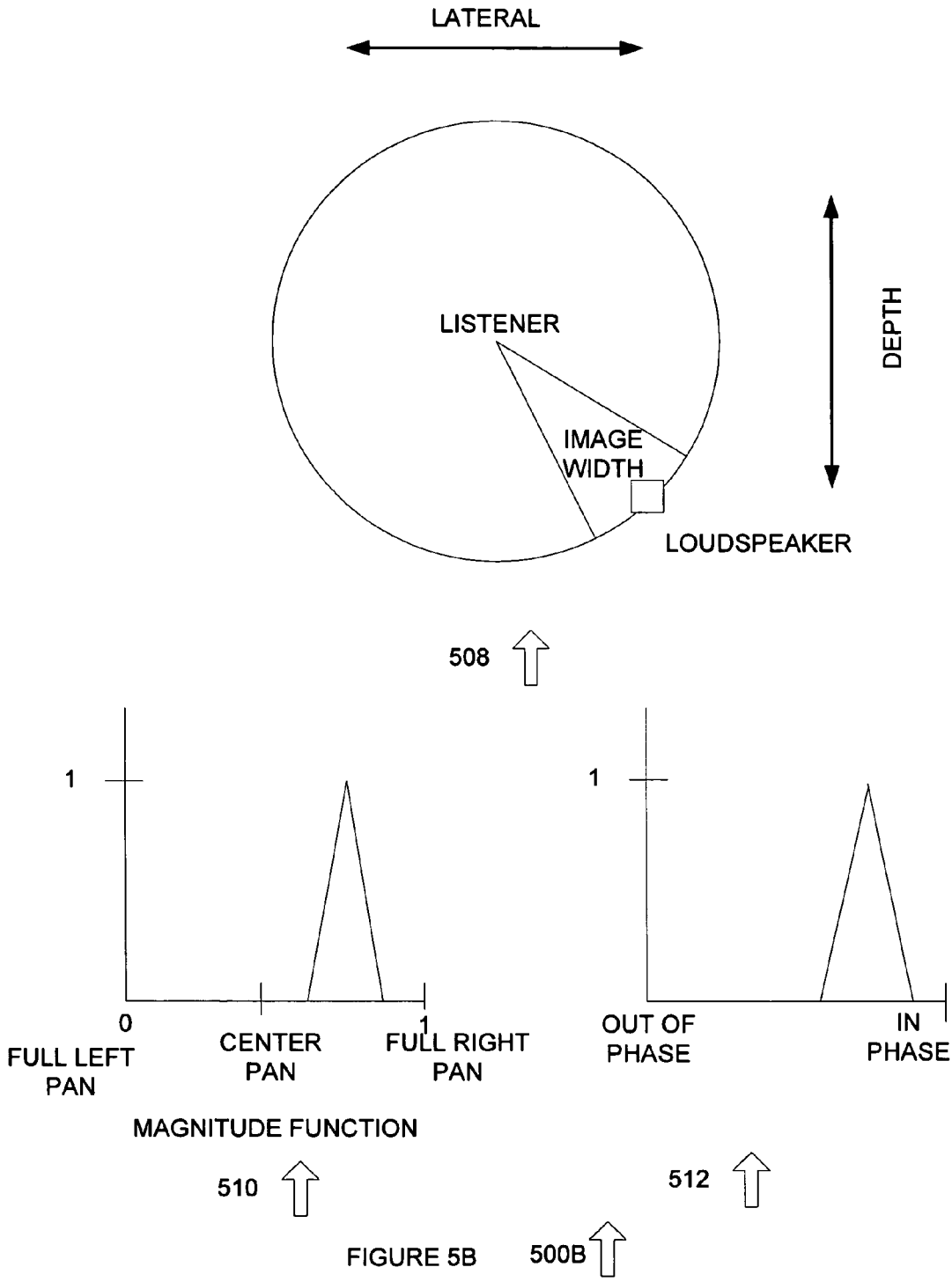
Figure 5C:
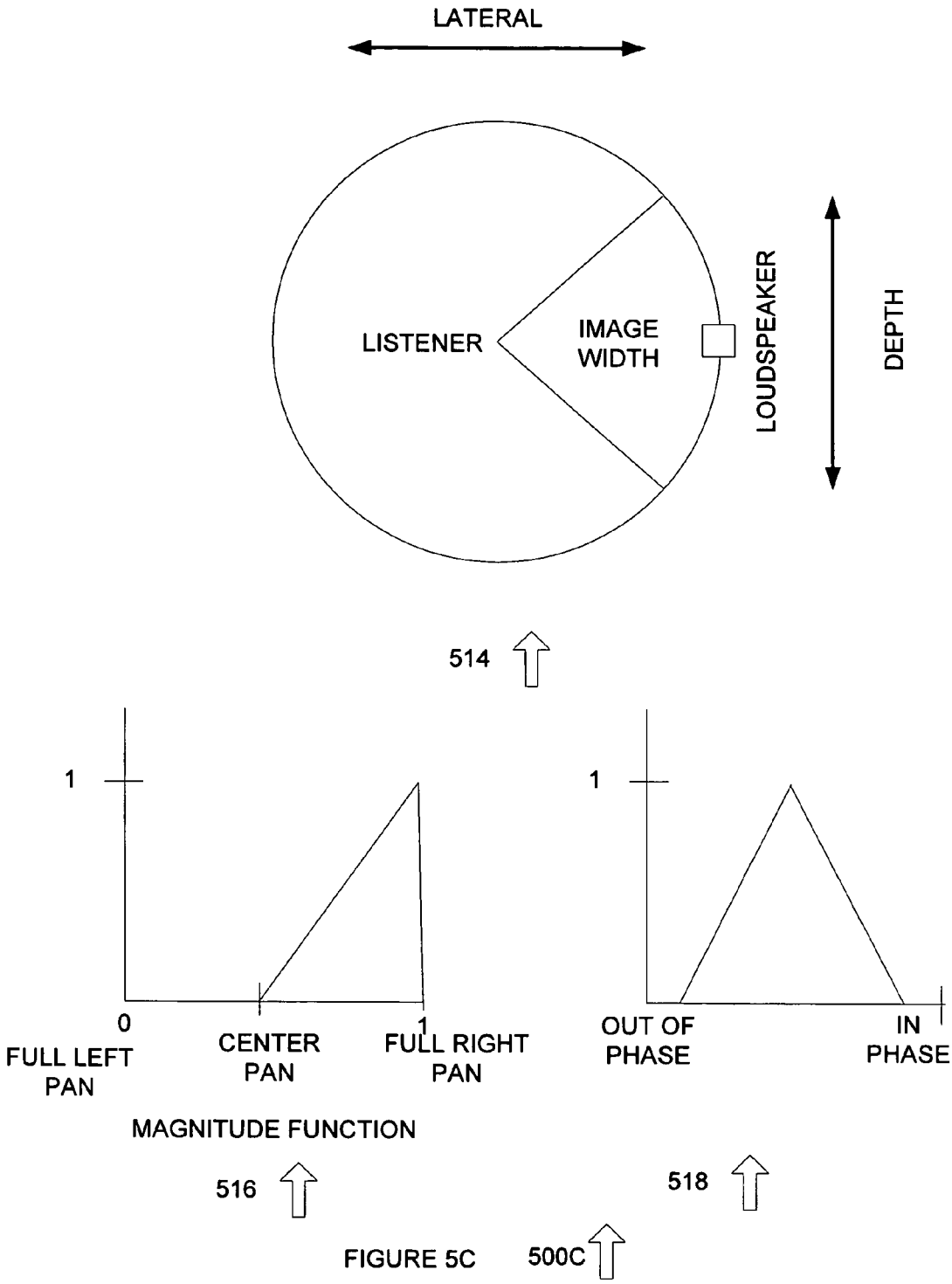
Figure 5D:
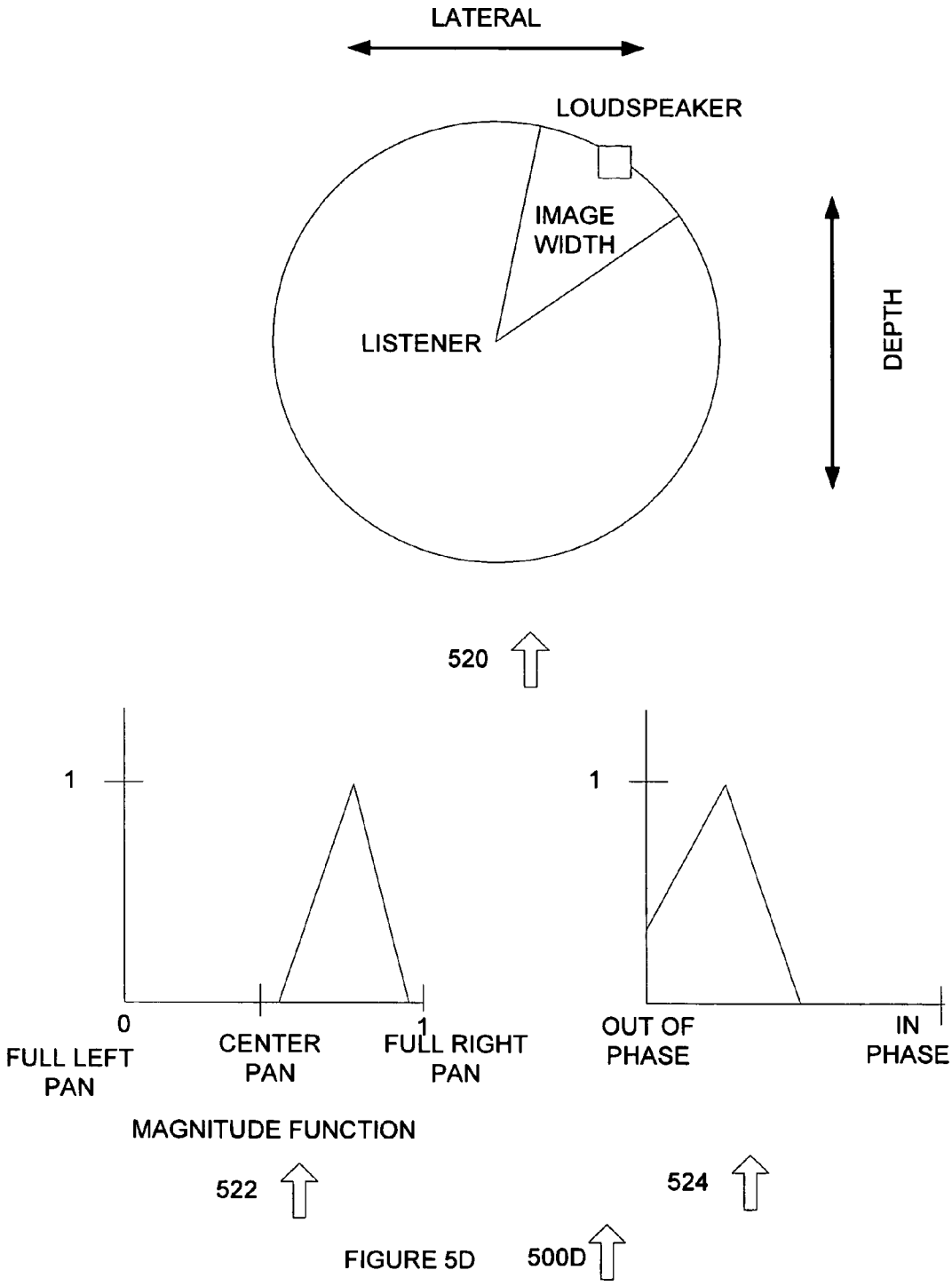

FIGS. 4A and 4B are a flow chart of a method 400 for converting two channel stereo sound into N-channel sound, such as 5.1 sound, in accordance with an exemplary embodiment of the present invention. Although method 500 will be described in regards to 5.1 sound, the process for deriving the values of the magnitude and phase functions will be described wherein suitable N-channel sound can be converted into M-channel sound, where N is an integer great than 2 and M is an integer greater than 1.

Method 400 begins at 402 where a time to frequency transform, such as a fast Fourier transform, is performed on a suitable sample, such as a 23.5 millisecond sample. The method then proceeds to 404, where a first frequency sub-band or bin is selected. The method then proceeds to 406 where the left-right magnitude difference is determined. The method then proceeds to 408 where the percentage energy in the left and right channels are determined as a percentage, such as by dividing the left channel energy by the sum of the left and right channel energy to generate the magnitude ratio value or M.R.V. The method then proceeds to 410.

At 410, the left and right magnitude values are selected as a function of the M.R.V. for the given frequency bin. The method then proceeds to 412 where the center magnitude values are selected as a function of the M.R.V. The method then proceeds to 414 where the left and right surround values are selected as a function of the M.R.V. The method then proceeds to 416.

At 416, the left-right phase difference or P.D. is determined. The P.D. is then used at 418, 420 and 422 to determine the front phase value, left-right phase value, and the rear phase value as a function of the P.D. The method then proceeds to 424 where the left and right magnitude values for the selected frequency bin are multiplied by the left-right phase value for the frequency bin to generate a first output. The method then proceeds to 426 where the center magnitude value for the frequency bin is multiplied by the front phase function value for the frequency bin to generate a second output. The method then proceeds to 428 where the left and right surround magnitude values for the selected frequency bin are multiplied times the rear phase value for the selected frequency bin to generate a third output. The method then proceeds to 430 in FIG. 4B.

At 430, the first and second output are added, and are then multiplied times the stereo left channel and stereo right channel values for the corresponding frequency bins to generate the left front channel output and the right front channel output for a 5.1 sound system. The method then proceeds to 432 where the center magnitude function for the frequency bin is multiplied times the left-right phase value for the frequency bin, which is then multiplied by the stereo left channel summed with the stereo right channel, to generate the center channel output for 5.2 sound. The method then proceeds to 434, where the left and right rear 5.1 sound outputs are generated for the selected frequency bin by subtracting the stereo right channel from the stereo left channel and multiplying the resultant value for the selected frequency bin times the third output value for the selected frequency bin. The method then proceeds to 436.

At 436, it is determined whether all sub0bands or bins for a time sample have been processed. If not, the method proceeds to 438 where the next sub-band or frequency bin is selected, the calculated values are stored, and the method returns to 406. Otherwise, the method proceeds to 440 where the frequency data is integrated over time to generate 5.1 sound.

In operation, method 400 allows stereo sound to be processed to generate N-channel sound, such as 5.1 sound. Extension of system 200 and method 400 to N-channels will be described in relation to the generation of the magnitude and phase functions for a predetermined integer number of input channels and output channels.

FIGS. 5A THROUGH 5D are diagrams of exemplary processes 500A through 500D for determining magnitude and phase functions as a function of loudspeaker location and image width, based on the depth and lateral location of the listener relative to the loudspeaker. Processes 500 can be extended and combined to handle a suitable combination of speakers in various locations relative to the listener.

Processes 500A through 500D include speaker location diagram 502, showing relative listener location and image width for a speaker, as well as corresponding graphs 504 and 506 for the magnitude function and phase function, respectively. The magnitude function 502 reaches a peak relative to full left pan and full right pan based on the lateral location of the speaker, with a window width at the base determined by the image width rendered by the speaker. Likewise, the window center for the phase function 504 is determined by the depth location of the loudspeaker, with the window width again being determined in relation to the image width rendered by the loudspeaker.

Speaker location diagrams 508, 514 and 520 further exemplify the magnitude functions 510, 516, and 522, and phase functions 512, 518 and 524, respectively, for various locations of a speaker relative to a listener and the relative image width to be rendered by that speaker. Thus, in the previous exemplary embodiments of FIGS. 1 through 4, it is evident how the magnitude and phase functions were determined for converting between a stereo to a 5.1 sound system, based on the well-known locations of the speakers in the stereo and 5.1 sound systems relative to the ideal listener. Using this concept, magnitude and phase functions can be generated for converting stereo 2-channel sound into sound suitable for any integer combination of speakers having a known depth and lateral location relative to a listener, and a known image width, and these magnitude and phase functions can be used to generate sound that projects the stereo image in the corresponding N-channel system.

Although exemplary embodiments of a system and method of the present invention have been described in detail herein, those skilled in the art will also recognize that various substitutions and modifications can be made to the systems and methods without departing from the scope and spirit of the appended claims.

What is claimed is:

1. A system for converting from an N channel audio system to an M channel audio system, where N is an integer greater than M, comprising:

one or more correlators that are each configured for receiving two of the N channels of audio data and time-shifting at least one of the N channels of audio data thereby eliminating time delays less than a predetermined level between the channels to generate correlated channels of audio data, where the time delays less than the predetermined level are below a level perceptible by human listeners;

one or more phase shift systems, each configured for performing a phase shift on one or more of the correlated channels of audio data; and one or more summers configured for receiving at least one of the correlated channels of audio data and at least one of the phase shifted channels of audio data and generating one of the M channels of audio data.

2. The system of claim 1 wherein one or more of the summers is configured for receiving one or more of the N channels of audio data that has not been correlated or phase shifted.

3. The system of claim 2 further comprising a multiplier configured for multiplying one or more of the channels of audio data that has not been correlated or phase shifted by a scaling factor.

4. The system of claim 1 wherein the correlators further comprise:

a first correlator configured for time-shifting at least one of the left front channel audio data and the right front channel audio data for eliminating time delays below a predetermined level between the left front channel audio data and the right front channel audio data and outputting correlated left front channel audio data and correlated right front channel audio data; and a second correlator configured for time-shifting at least one of the left rear channel audio data and the right rear channel audio data for eliminating time delays below a predetermined level between the left rear channel audio data and the right rear channel audio data and outputting correlated left rear channel audio data and correlated right rear channel audio data.

5. The system of claim 4 wherein the correlators further comprise:

a third correlator configured for time-shifting at least one of the correlated left front channel audio data and the correlated left rear channel audio data for eliminating time delays below a predetermined level between the correlated left front channel audio data and the correlated left rear channel audio data and outputting correlated left front channel audio data and correlated left rear channel audio data; and a fourth correlator configured for time-shifting at least one of the correlated right front channel audio data and the correlated right rear channel audio data for eliminating time delays below a predetermined level between the correlated right front channel audio data and the correlated right rear channel audio data and outputting correlated right front channel audio data and correlated right rear channel audio data.

6. The system of claim 5 wherein the phase shift is performed on the correlated left rear audio data and the correlated right rear channel audio data.

7. The system of claim 5, wherein the correlated front channel audio data and correlated left rear channel audio data are summed with center channel data to generate a stereo left channel output as one of the M channels.

8. The system of claim 5, wherein the correlated right rear channel is subtracted from the sum of the correlated right front channel data and the center channel data to generate a stereo right channel output as one of the M channels.

9. The system of claim 1, wherein the one or more correlators eliminates time delays between two of the N channels below a predetermined level of 7 ms.

10. The system of claim 1, wherein the one or more phase shift systems are configured for performing a Hilbert transform on one of the correlated channels of audio data.

11. The system of claim 10, wherein negative frequencies of the correlated channels get a +90° phase shift and positive frequencies of the correlated channels get a −90° phase shift.

12. An apparatus for converting a surround audio signal to a stereo signal, comprising:

a system configured for time-shifting at least one of a left front channel signal and a left rear channel signal thereby eliminating any time delays below a predetermined level between the left front and left rear channel signals, where the time delays below the predetermined level are below a level perceptible by human listeners, and further processing the left front channel signal and a the left rear channel signal to generate a left intermediate output containing first spatial relationship data based on the left front channel signal and the left rear channel signal;

a system configured for processing a right front channel signal and a right rear channel signal to generate a right intermediate output containing second spatial relationship data based on the right front channel signal and the right rear channel signal;

a system configured for processing the left intermediate output and a center channel input to generate an enhanced stereo left channel signal containing the first spatial relationship data; and a system configured for processing the right intermediate output and the center channel input to generate an enhanced stereo right channel signal containing the second spatial relationship data.

13. The apparatus of claim 12 wherein the system configured for processing the right front channel signal and the right rear channel signal to generate the right intermediate output comprises a correlation system configured for time-shifting the phase of the right front channel signal and the right rear channel signal thereby eliminating any time delays below a predetermined level between the right front and right rear channel signals.

14. The apparatus of claim 12 wherein the systems configured for processing the left intermediate output, the right intermediate output and the center channel input to generate the enhanced stereo left channel signal and the enhanced stereo right channel signal each comprise a summer.

15. The apparatus of claim 12 wherein the systems configured for processing the left intermediate output, the right intermediate output and the center channel input to generate the enhanced stereo left channel signal and the enhanced stereo right channel signal operable as a down mixer.

16. A method for converting a surround audio signal to a stereo signal, comprising:

time-shifting at least one of a left front channel signal and a left rear channel signal thereby eliminating any time delays below a predetermined level between the left front and left rear channel signals, where the time delays below the predetermined level are below a level perceptible by human listeners, generating a left intermediate signal from the left front channel signal and the left rear channel signal;

generating a right intermediate signal from a right front channel signal and a right rear channel signal;

generating an enhanced stereo left channel signal from the left intermediate signal and a center channel signal; and generating an enhanced stereo right channel signal from the right intermediate signal and the center channel signal.

17. The method of claim 16 wherein generating the enhanced stereo left channel signal and the enhanced stereo right channel signal from the left intermediate signal, the right intermediate signal and the center channel signal comprises combining the left intermediate signal and the center channel signal and combining the right intermediate signal and the center channel signal.

18. The method of claim 16 wherein generating the enhanced stereo left channel signal signal from the left intermediate signal and the center channel signal and generating the enhanced stereo right channel signal from the right intermediate signal and the center channel comprises down mixing the left intermediate signal, the right intermediate signal and the center channel signal.

* * * * *